US005857712A

United States Patent [19]

Kato

[11] Patent Number: 5,857,712

[45] Date of Patent: Jan. 12, 1999

[54] CABLE DAMPING DEVICE

[75] Inventor: Seinosuke Kato, Nishinomiya, Japan

[73] Assignee: Sumitomo Rubber Industries, Ltd., Kobe, Japan

[21] Appl. No.: 910,882

[22] Filed: Aug. 13, 1997

[30] Foreign Application Priority Data

Aug. 20, 1996 [JP] Japan ..... 8-218357

[51] Int. Cl.[6] ..... F16L 11/12

[52] U.S. Cl. ..... 285/49; 464/92; 248/612

[58] Field of Search ..... 248/610, 611, 248/612, 613, 614, 49, 58, 62, 63, 68.1; 285/49, 115, 116; 464/81, 92, 93, 94, 96; 174/65 G, 65 SS; 403/374.1; 52/219, 167.1

[56] References Cited

U.S. PATENT DOCUMENTS

| | | | |
|---|---|---|---|
| 2,360,149 | 10/1944 | Moser | 464/92 |
| 2,659,218 | 11/1953 | Riopelle | 464/93 |
| 2,692,782 | 10/1954 | Jones | 138/133 |
| 2,840,180 | 6/1958 | Nobles et al. | 181/252 |
| 2,846,857 | 8/1958 | Hagnenlocher | 464/95 |
| 3,004,411 | 10/1961 | Bugel | 464/411 |
| 3,013,310 | 12/1961 | Foster et al. | 264/573 |
| 3,538,653 | 11/1970 | Meckler | 52/1 |
| 3,798,924 | 3/1974 | Downey | 64/13 |
| 3,985,378 | 10/1976 | Muller | 285/49 |
| 4,045,057 | 8/1977 | Halter | 285/49 |
| 4,642,948 | 2/1987 | Travis | 52/79.13 |
| 4,674,336 | 6/1987 | Coenen et al | 156/580.1 |
| 4,714,229 | 12/1987 | Force et al. | 248/610 |
| 5,141,259 | 8/1992 | Highlen et al. | 285/49 |
| 5,259,159 | 11/1993 | Kawase et al. | 52/167 R |
| 5,299,837 | 4/1994 | Lagier | 285/49 |
| 5,685,199 | 11/1997 | Malone | 74/502.4 |
| 5,772,158 | 6/1998 | Blanding | 248/49 |

FOREIGN PATENT DOCUMENTS

| | | |
|---|---|---|
| 6-136718 | 5/1994 | Japan . |
| 7-3720 | 1/1995 | Japan . |

*Primary Examiner*—Leslie A. Braun
*Assistant Examiner*—Tan Le
*Attorney, Agent, or Firm*—Nikaido Marmelstein Murray & Oram LLP

[57] ABSTRACT

A vibration dumping device for cables used in a diagonal stress bridge is disclosed. The dumping device includes an anchor pipe 5, an anchor flange 7, and a cable flange 9. The anchor flange 7 is secured to the anchor pipe 5, while the cable flange 9 is secured to the cable 6 in an encircling relationship. The dumping device also includes an aligning flange 8. The aligning flange 8 includes mounting portions (slotted holes) 8*c* which permits the aligning flange 8 to be mounted on the anchor flange 7 in an eccentric relationship therewith. The aligning flange 8 also includes mounting seats (stud bolts) 8*b* for visco-elastic bodies 11. The aligning flange 8 is mounted on the anchor flange 7, with the center defined by the mounting seats 8*b* for the visco-elastic bodies being aligned with the longitudinal center of the cable 6. The visco-elastic bodies 11 are clampedly mounted between the aligning flange 8 and the cable flange 9.

4 Claims, 6 Drawing Sheets

CABLE DAMPING DEVICE

FIELD OF THE INVENTION

The invention relates to a device for damping vibration of cables used in a diagonal stress bridge.

BACKGROUND OF THE INVENTION

A construction for restricting or damping vibration of cables of a diagonal stress bridge is known in the art. Such a construction includes, as shown in FIG. 13, an anchor pipe 2 or protective pipe disposed at a position on a girder or tower of a bridge to which an end of cable 1 is connected. The anchor pipe 2 includes a flange 3 which encircles the cable 1. A plurality of visco-elastic bodies 4 are disposed between the flange 3 and the cable 1. Vibration of the cable 1 causes shear deformation in the visco-elastic bodies 4, so as to cause energy loss in the visco-elastic bodies 4, thus restricting or damping vibration of the cable 1 (see Japanese Patent Public Disclosure No. 06-136718 (KOKAI HEI-6-136718) and Japanese Patent Public Disclosure No. 07-3720 (KOKAI HEI-6-3720).

A diagonal stress bridge is constructed by first erecting main towers. Then, steel girders or girders of prestressed concrete are extended outwardly from the main towers. The girders are connected to and supported by the main towers using diagonal members (cables). Further girders are constructed in repetitive manner.

Thus, the amount of tension to be carried by the cables varies at a given time during the course from the initial stage to the completion of the construction work. Accordingly, the core of the cable 6 disposed centrally of the cables is caused to be offset from an intended position for design, or to be changed in its angle of inclination. In an actual large bridge, the amount of such an eccentricity may be even on the order of some tens millimeters.

Under the circumstances, the vibration damping device disclosed in Japanese Patent Public Disclosure No. 6-136718 or 7-3720 mentioned above is frequently difficult to be mounted between the anchor pipe 2 and the cable 1.

That is to say, the configuration of a visco-elastic body 4 is, in essence, determined by an expected spring constant or damping constant, and the thickness of the visco-elastic body is on the order of 20 to 80 millimeters. Thus, positional adjustment in the amount of some tens millimeters during mounting is not achieved by solely deforming the visco-elastic body.

In practice, the procedure of mounting the anchor pipe 2 on a girder 2 is delayed until the tension of the cable becomes unchanged as when the bridge is almost completed. Then, the longitudinal center of the anchor pipe 2 is aligned with the longitudinal center of the cable. This restricts fabrication work for girders and towers, or mounting work for the anchor pipes.

SUMMARY OF THE INVENTION

It is an object of the invention to provide a vibration damping device which gives a high degree of freedom with regard to fabrication work, without causing the above-mentioned restriction during fabrication work.

According to the invention, a cable damping device is provided which includes an anchor pipe housing therein a fixed end of a cable, an anchor flange disposed at a free end of the anchor pipe for encircling the cable in a non-contact relationship therewith, a cable flange attached to the cable, and a plurality of visco-elastic bodies mounted between the anchor flange and the cable flange.

The cable damping device is characterized by comprising:

an aligning flange including a plurality of mounting portions to be mounted on the anchor flange in an eccentric relationship with the anchor flange, and a plurality of mounting seats on which the visco-elastic bodies disposed around the cable are mounted, whereby the aligning flange may be mounted on the anchor flange in a manner that the center defined by the plurality of mounting seats is aligned with the longitudinal center of the cable, and that the plurality of visco-elastic bodies are clamped between the aligning flange and the cable flange.

The mounting portions of the aligning flange may be a plurality of slotted holes, the slotted holes being formed through the aligning flange with the longitudinal axes of the slotted holes being aligned in one direction, whereby a plurality of bolts protruding from the anchor flange may be slidably received in the slotted holes.

The anchor flange, the cable flange and the aligning flange may be of a split construction, so that they are mounted to the cable and the anchor pipe at a later time.

The anchor flange may be adapted to be secured to the anchor pipe by means of bolts.

BRIEF DESCRIPTION OF THE DRAWINGS

For a fuller understanding of the nature and objects of the present invention, reference should be had to the following detailed description taken in connection with the accompanying drawings wherein.

DETAILED DESCRIPTION OF THE PREFERRED EMBODIMENTS

Figure 1B:
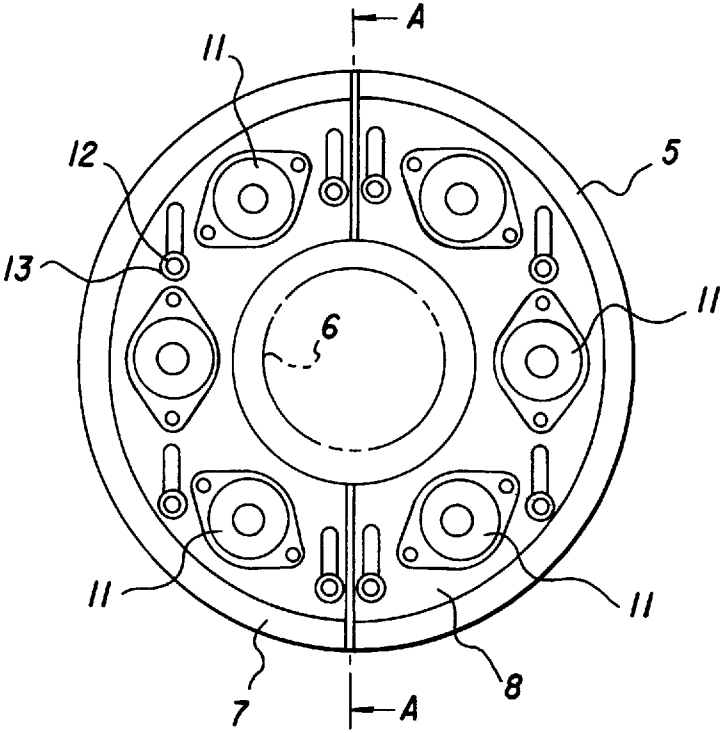
FIG. 1 shows a cable damping device according to one embodiment of the invention in an assembled state, wherein FIG. 1(*a*) is a cross-sectional view along line A—A of FIG. 1(*b*), and FIG. 1(*b*) is a cross-sectional view along line B—B of FIG. 1(*a*)
Figure 1A:
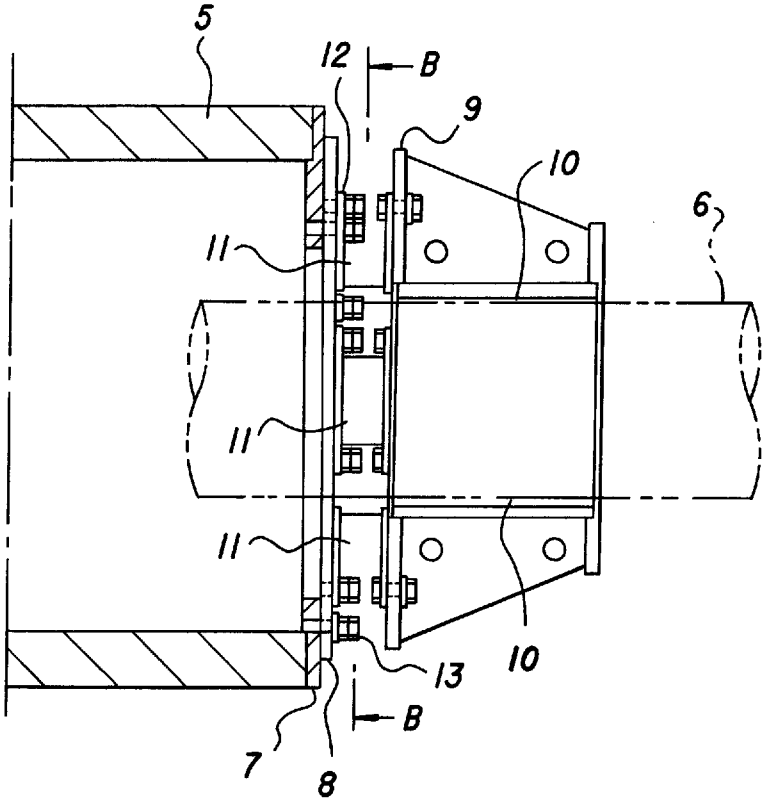

One embodiment of the invention in an assembled state is shown in FIGS. 1(*a*) and 1(*b*). It is noted that, in this case, a cable is arranged in a non-eccentric relationship relative to an anchor pipe.

In the drawings, reference numeral 5 designates an anchor pipe. The anchor pipe 5 is secured, at its proximal end, to a girder of a tower of a bridge construction. Reference numeral 6 designates a cable. The cable 6 is drawn into an the anchor pipe 5 and anchored, at its left-hand end when viewed in FIG. 1(*a*), to the girder of a tower of a bridge. Reference numeral 7 designates an anchor flange. The anchor flange 7 is secured, by welding, to the free end of the anchor pipe 5. Reference numeral 8 designates an aligning flange. The aligning flange 8 is superposed on the anchor flange 7 and secured to the anchor flange 7 by means of a plurality of bolts. Reference numeral 9 designates a cable flange. The cable 6 is clamped by the cable flange 9 with a rubber sheet 10 being interposed therebetween. Reference numeral 11 designates rubber bearings (six in the illustrated embodiment) of a high damping characteristic formed from a visco-elastic body. The rubber bearings 11 are disposed between the aligning flange 8 and the cable flange 9. The rubber bearings 11 are secured, by means of bolts, at positions distributed equidistantly in the circumferential direction, whereby the aligning flange 8 and the cable flange 9 are connected together.

Figure 2A:
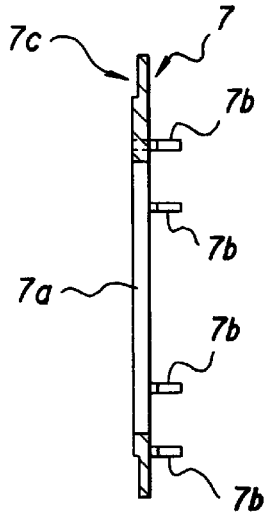
FIG. 2(*a*) is a cross-sectional view of an anchor flange of FIG. 1, and FIG. 2(*b*) is a front elevational view of the anchor flange.
Figure 2B:
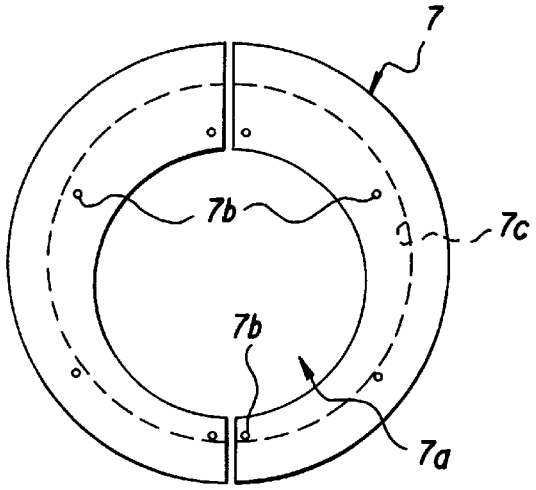

The anchor flange 7 includes, as shown in FIGS. 2(*a*) and 2(*b*), an opening 7*a* eccentrically disposed or offset with respect to the outer diameter thereof, and stud bolts 7*b* disposed at angular positions around the opening 7*a* for attachment of the aligning flange 8 on the anchor flange 7. A stepped portion 7*c* is formed in the peripheral portion of the anchor flange 7 for securely aligning the anchor flange 7 with respect to the end of anchor pipe 5.

Figure 3A:
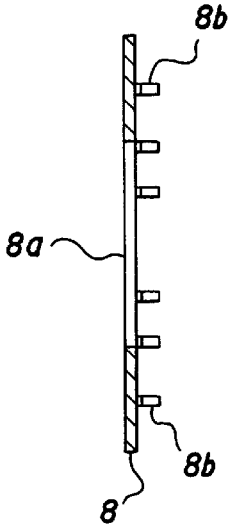
FIG. 3(*a*) is a cross-sectional view of an aligning flange of FIG. 1, and FIG. 3(*b*) is a front elevational view of the aligning flange.
Figure 3B:
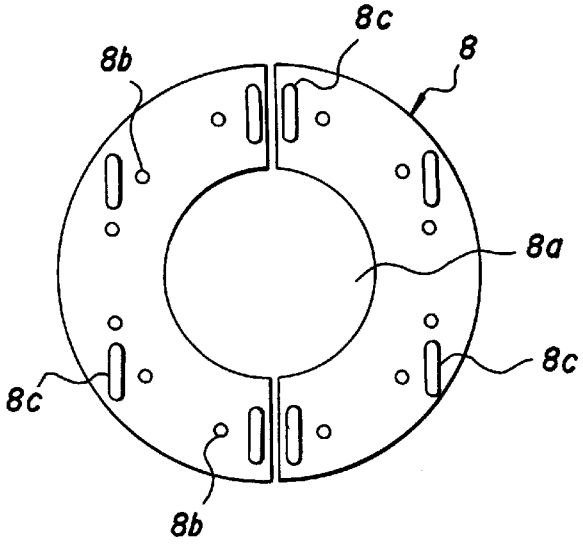
Figure 4A:
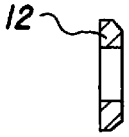
FIG. 4(*a*) is a cross-sectional view of a washer of FIG. 1 which is used to retain a bolt of the anchor flange protruding from a slotted hole in the aligning flange, and FIG. 4(*b*) is a front elevational view of the washer.
Figure 4B:
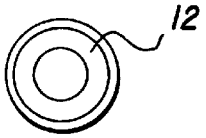

The aligning flange 8 includes, as shown in FIGS. 3(*a*) and 3(*b*), an opening 8*a,* a plurality of stud bolts 8*b* and a plurality of slotted holes 8*c* or elongated holes (mounting portions) 8*c*. The opening 8*a* is located centrally of the aligning flange 8 in an concentric manner with the outer diameter of the opening 8*a*. The opening 8*a* has a diameter sufficient for freely accommodating the cable 6 therein. The stud bolts 8*b* are arranged in the circumferential direction along a circle which is in an concentric relationship with the opening 8*a*. Each of the stud bolts 8*b* serves as a visco-elastic mounting seat. Each of the slotted holes 8*c* is configured so as to slidably receive therein a corresponding stud bolt 7*b*. The slotted holes 8*c* are formed in alignment with the direction in which the opening 7*a* is off set as mentioned above (this direction will be simply referred to as "offset direction" in this specification). The stud bolts 7*b* of the anchor flange 7, having been passed through the respective slotted holes 8*c*, are tightened by means of nuts 13, as shown in FIGS. 1(*a*) and 1(*b*), with a corresponding washer shown in FIGS. 4(*a*) and 4(*b*) being interposed therebetween.

Figure 5C:
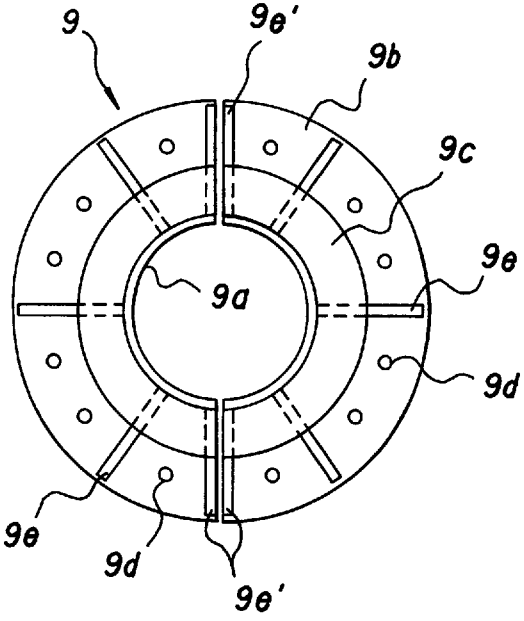
FIG. 5(*a*) is a front elevational view of a cable flange of FIG. 1, FIG. 5(*b*) is a side elevational view, in section, of the cable flange, and FIG. 5(*c*) is a rear view of the cable flange.
Figure 5B:
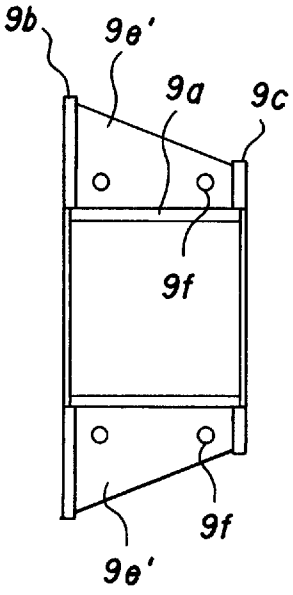
Figure 5A:
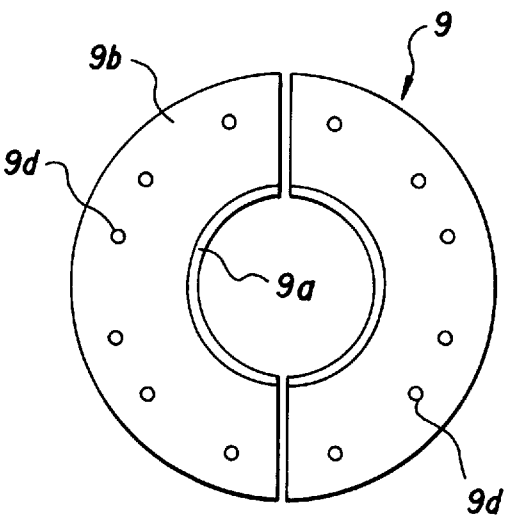
Figure 6A:
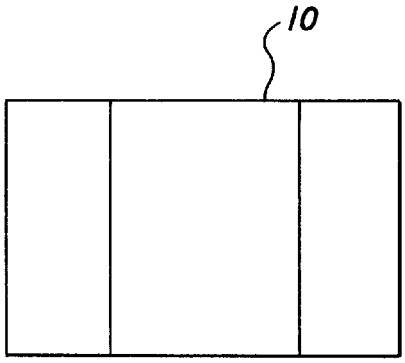
FIG. 6(*a*) is a plan view of a rubber sheet of FIG. 1, and FIG. 6(*b*) is a side elevational view of the rubber sheet.
Figure 6B:
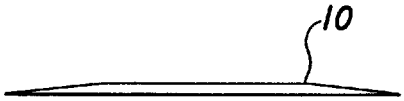

The cable flange 9 includes, as shown in FIGS. 5(*a*), 5(*b*) and 5(*c*), a tube 9*a* split into two halves in the longitudinal direction, and a flange of a larger diameter 9*b* and a flange 9*c* of a smaller diameter attached to the forward and rearward ends of the tube 9*a,* respectively. The flange 9*b* of a larger diameter is provided, along its periphery, with apertures 9*d* for attachment of a respective high-damping rubber bearing 11 to the flange 9*b*. The tube 9*a* is formed, in its outer periphery, with a plurality of reinforcing ribs 9*e* connecting the flanges 9*b* and 9*c* together. The pair of ribs 9*e*', oppositely disposed at each location at which the tube 9*a* is split into two halves, are formed with apertures 9*f*. A bolt is inserted through each aperture 9*f* so as to cause the two halves of the tube 9*a* to be tightened together.

The rubber sheet 10 is thinned at its longitudinal (the direction in which the sheet is wound) opposite ends. Thus, the rubber sheet 10 may be easily contacted on the outer peripheral surface of the cable 6 when the rubber sheet 10 is clamped between the cable flange 9 and the cable 6.

Figure 7A:
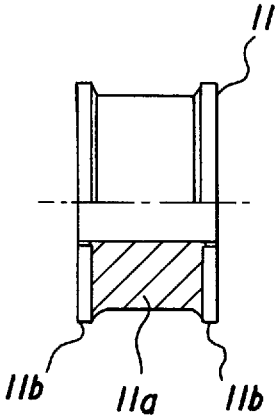
FIG. 7(*a*) is a side elevational view of a high-damping rubber damper of FIG. 1, and FIG. 7(*b*) is a front elevational view of the damper.
Figure 7B:
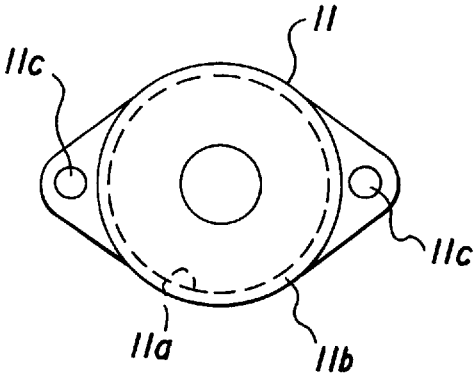

Bach of the high-damping rubber bearing 11 includes, as shown in FIGS. 7(*a*) and 7(*b*), a pair of mounting flanges 11*b* and 11*b,* and a high-damping rubber body 11*a* of a visco-elastic material. The high-damping rubber body 11*a* is disposed between the pair of mounting flanges 11*b* and 11*b* and bonded integrally with the mounting flanges 11*b* and 11*b* by means of vulcanization. The high-damping rubber bearing 11 absorbs vibrational energy by converting shear deformation into thermal energy. The high-damping rubber bearing 11 is secured to the aligning flange 8 and the cable flange 9 by means of bolts inserted in mounting holes 11*c* formed in the opposite ends of each of the mounting flanges 11*b* and 11*b*.

The cable 6 and the anchor pipe 5 of the cable damping device according to the above-mentioned embodiment are fixed to the structure of a diagonal stress bridge when the construction work in-progress thereof has reached a predetermined location. The remaining parts of the cable damping device are attached to the structure when the diagonal stress bridge is nearly completed. Thus, each of the anchor flange 7 and the aligning flange 8 is also split into two halves (left-hand and right-hand halves), in a manner same as that of the cable flange 9.

The aligning flange 8 of the cable damping device is constructed to adjust eccentricity of the cable 6 relative to the anchor pipe 5. The mounting method of the aligning flange 8 of the cable damping device will be explained below with regard to three examples shown in FIGS. 8 to 10.

Figure 8A:
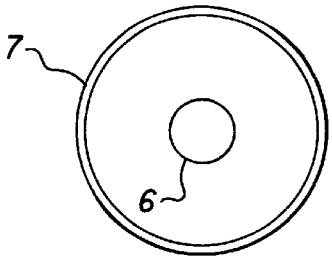
FIGS. 8(*a*) through 8(*c*) illustrate positional relationships between the anchor flange and the aligning flange mounted on the anchor pipe (when the cable and the anchor pipe is in concentric relationship)
Figure 8B:
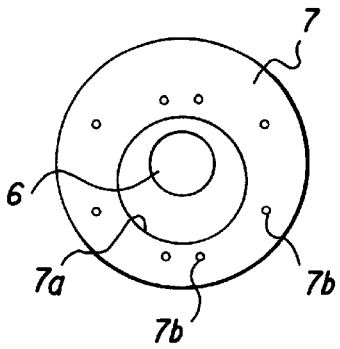
Figure 8C:
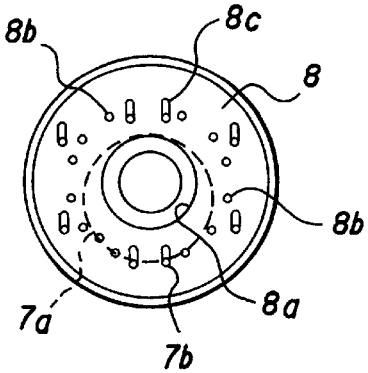

When the anchor pipe 5 and the cable 6 are arranged in a concentric relationship relative to one another, as shown in FIG. 8(*a*), the anchor flange 7 may be oriented in any direction. If the anchor flange 7 is mounted as shown in FIG. 8(*b*), mounting of the aligning flange 8 is performed first by inserting the stud bolts 7*b* into the respective slotted holes 8*c*, as shown in FIG. 8(*c*). Then, the aligning flange 8 is slidably moved in the direction opposite to the offset direction of the opening 7*a*, so as to cause the opening 8*a* of the aligning flange 8 and the cable 6 to be aligned in a concentric relationship. Since the stud bolts 8*b* formed on the aligning flange 8 for mounting the high-damping bearings are arranged on a circle in concentric with the aperture 8*a*, as shown in FIG. 3, it is possible for the high-damping bearings to be mounted at rotationally symmetrical positions with respect to the center of the cable 6. The rotationally symetrical positions correspond to the positions of the high-damping rubber bearings 11 of the cable flange 9 which are arranged so as to encircle the cable 6.

Figure 9A:
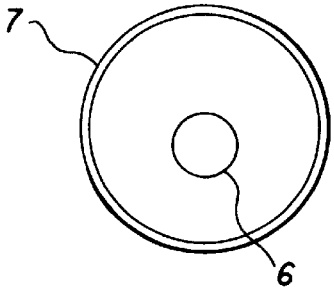
FIGS. 9(*a*) through 9(*c*) illustrate positional relationships between the anchor flange and the aligning flange mounted on the anchor pipe (when the cable is offset in a downward direction)
Figure 9B:
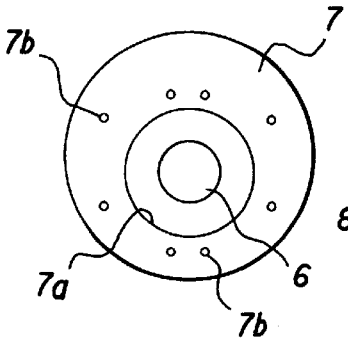
Figure 9C:
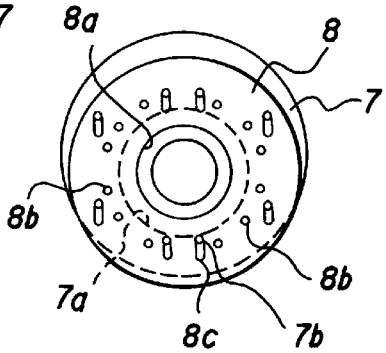

When the cable 6 is offset in a downward direction with respect to the anchor pipe 5, as shown in FIG. 9(*a*), the anchor flange 7 is secured by welding to the anchor pipe 5, with the opening 7*a* of the anchor flange being disposed at a lower position, as shown in FIG. 9(*b*). With this state, mounting of the aligning flange 8 is performed by slidably moving the aligning flange 8 in the direction the sane as the offset direction of the opening 7*a*, so as to cause the opening 8*a* of the aligning flange and the cable 6 to be aligned in a concentric relationship, as shown in FIG. 9(*c*). At this time, the outer diameter of the aligning flange 8 is offset from the outer diameter of the anchor flange 7, but is arranged in concentric relationship with regard to the cable 6 and the cable flange 9, so that the high-damping rubber bearings 11 may be disposed at proper positions.

Figure 10A:
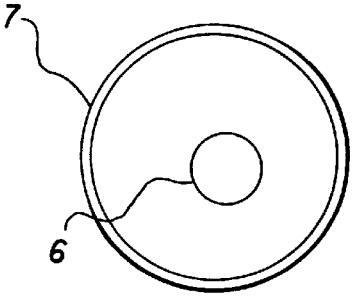
FIGS. 10(*a*) through 10(*c*) illustrate positional relationships between the anchor flange and the aligning flange mounted on the anchor pipe (when the cable is offset in a downward and right-hand direction)
Figure 10B:
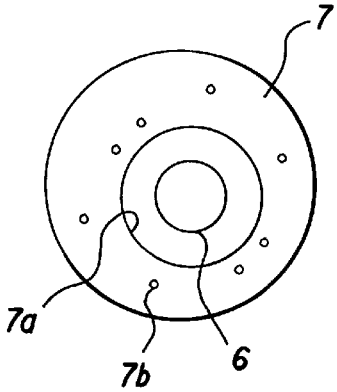
Figure 10C:
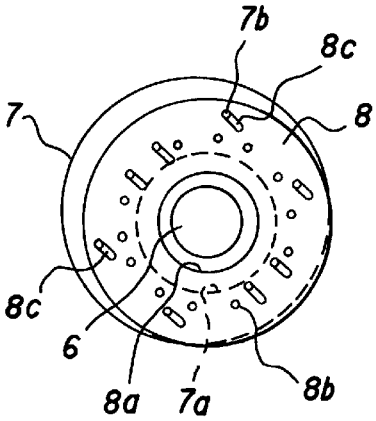

When the cable 6 is offset in a downward and right-hand direction with respect to the anchor pipe 5, as shown in FIG. 10(*a*), the anchor flange 7, with its mounting direction oriented in a downward and right-hand direction, and the aligning flange 8, with its slide direction in a downward and right-hand direction, are mounted, as shown in FIGS. 10(*b*) and 10(*c*), substantially in accordance with the example of FIG. 9. In this case, the opening 8*a* of the aligning flange 8 and the cable 6 are also arranged in a concentric relationship relative to one another, so that mounting positions of the high-damping bearings 11 correspond to the cable flange 9.

With the aligning flange 8 mounted as shown in FIG. 8(*c*), FIG. 9(*c*) or FIG. 10(*c*), the high-damping rubber bearings 11 are secured, by bolts, to the aligning flange 8. Then, the cable flange 9, with its apertures 9*d* aligned with the positions of the high-damping rubber bearings 11, is mounted so as to encircle the cable 6. The high-damping rubber bearings 11 are secured, by bolts, to the cable flange 9. Finally, the two halves of the cable flange 9 are fastened together by means of bolts, whereby mounting operation is completed.

The cable damping device assembled as shown in FIG. 1 is capable of very effectively restricting vibration of the cable 6. This is because that, when the cable 6 is vibrated relative to the fixed or stationary anchor pipe 5 due to wind, rain or the like, shear deformation of the visco-elastic bodies 11*a* of the high-damping rubber dampers 11 is caused due to the relative movement between the aligning flange 8 and the cable flange 9. The shear deformation causes internal loss which contributes to restriction of vibration of the cable 6.

Figure 11A:
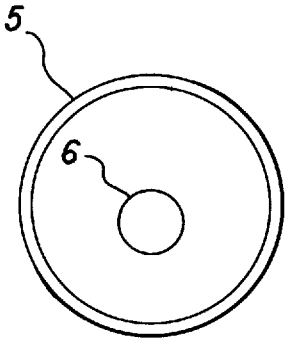
FIGS. 11(*a*) through 11(*c*) illustrate positional relationships between the anchor flange and the aligning flange mounted on the anchor pipe (when an anchor flange having an opening in concentric with its outer diameter)
Figure 11B:
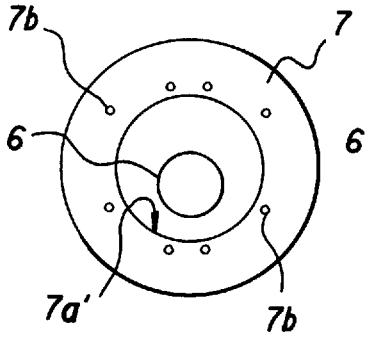
Figure 11C:
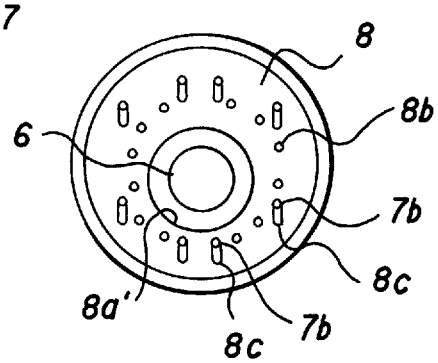
Figure 12:
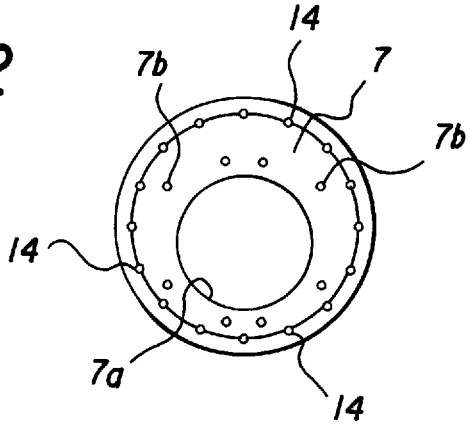
FIG. 12 illustrates an and surface of an anchor pipe, the anchor pipe being formed in the end surface with bolts by which the anchor flange is secured to the anchor pipe.
Figure 13:
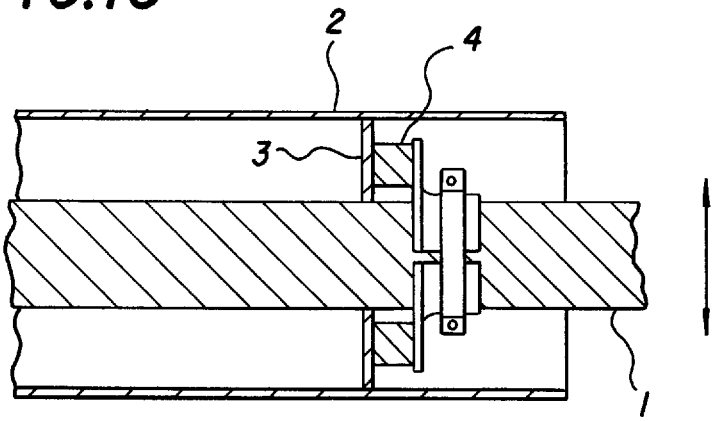
FIG. 13 shows a prior art cable damping device.

The above embodiment is explained with regard to the anchor flange 7 having an opening 7*a* offset with respect to its outer diameter, as shown in FIG. 2, and with regard to the aligning flange 8 having an opening 8*a* in concentric with its outer diameter, as shown in FIG. 3. It is noted, however, that, as shown in FIGS. 11(*a*), 11(*b*) and 11(*c*), the anchor flange 7 may include an opening 7*a*' in concentric with its outer diameter, and that the aligning flange 8 may include an opening offset with respect to its outer diameter. Such anchor flange and aligning flange may be mounted in a manner similar to that mentioned above.

In this connection, it is noted that, when the anchor flange 7 includes an opening 7*a*' in concentric with its outer diameter, the opening should have a diameter greater than that of the opening 7*a* which is offset with respect to the outer diameter of the anchor flange 7.

In the above embodiment, the anchor flange 7 is secured to the anchor pipe 5 by means of welding. It is noted, however, that the anchor pipe 5 may be provided, in its end surface, with threaded holes 14, so that the anchor flange 7 is bolted to the anchor pipe 5.

When sixteen (16) threaded holes 11 are formed at positions which are equidistantly distributed along a circle on the end surface of the anchor pipe 5, the rotational position of the anchor flange 7 may be adjusted by an angular pitch of 22.5 degrees depending upon a given degree of eccentricity of the cable 6. When twenty four (24) threaded holes 11 are formed, the rotational position of the anchor flange 7 may be adjusted by an angular pitch of 15 degrees.

The cable damping device according to the invention is so constructed that the aligning flange 8 may be mounted, with the opening thereof being eccentrically disposed, in accordance with the direction of eccentricity of the cable 6. By this, the centers of the positions, at which the high-damping rubber bearings are mounted on the aligning flange 8 and the cable flange 9, may be always maintained in a concentric relationship. Thus, any useless efforts to align the anchor pipe 5 with the longitudinal center of the cable 6 during fabrication work may be obviated. Accordingly, the high-damping rubber bearings 11 may be easily mounted between the aligning flange 8 and the cable flange 9, without causing any excess strain or deformation in the rubber bearings.

It will further be obvious to those skilled in the art that many variations may be made in the above embodiments, here chosen for the purpose of illustrating the present invention, and full result may be had to the doctrine of equivalents without departing from the scope of the present invention, as defined by the appended claims.

I claim:

1. A cable damping device including an anchor pipe housing therein a fixed end of a cable, an anchor flange disposed at a free end of the anchor pipe for encircling the cable in a non-contact relationship therewith, a cable flange attached to the cable, and a plurality of visco-elastic bodies mounted between the anchor flange and the cable flange, characterized in that said cable damping device comprises:

an aligning flange including a plurality of mounting portions to be mounted on said anchor flange in an eccentric relationship with said anchor flange, and a plurality of mounting seats on which said visco-elastic bodies disposed around said cable are mounted, whereby said aligning flange may be mounted on said anchor flange in a manner that the center defined by said plurality of mounting seats is aligned with the longitudinal center of said cable, and that said plurality of visco-elastic bodies are clamped between said aligning flange and said cable flange.

2. The cable damping device according to claim 1, wherein said mounting portions of said aligning flange include a plurality of slotted holes, said slotted holes being formed through said aligning flange with the longitudinal axes of said slotted holes being aligned in one direction, whereby a plurality of bolts protruding from said anchor flange may be slidably received in said slotted holes.

3. The cable damping device according to claim 1 or 2, wherein said anchor flange, said cable flange and said aligning flange are of a split construction, so that they may be mounted to said cable and said anchor pipe at a later time.

4. The cable damping device according to claim 1 or 2, wherein said anchor flange is adapted to be secured to said anchor pipe by means of bolts.

* * * * *